US005909230A

United States Patent [19]

Choi et al.

[11] Patent Number: 5,909,230

[45] Date of Patent: Jun. 1, 1999

[54] RECORDING APPARATUS USING MOTIONAL INERTIA OF MARKING FLUID

[75] Inventors: Hae Yong Choi; Kwang Kyun Jang, both of Kyunggi-do, Rep. of Korea

[73] Assignee: Samsung Electro-Mechanics Co. Ltd., Suwon, Rep. of Korea

[21] Appl. No.: 08/692,198

[22] Filed: Aug. 5, 1996

[30] Foreign Application Priority Data

Mar. 27, 1996 [KR] Rep. of Korea ..... P96-8484

[51] Int. Cl.[6] ..... B41J 2/04

[52] U.S. Cl. ..... 347/54

[58] Field of Search ..... 347/54, 55, 56, 347/68, 40, 71, 87, 44

[56] References Cited

U.S. PATENT DOCUMENTS

| | | | |
|---|---|---|---|
| 4,336,544 | 6/1982 | Donald et al. | 347/54 |
| 4,367,480 | 1/1983 | Kotoh | 347/40 |
| 4,546,361 | 10/1985 | Brescia et al. | 347/54 |
| 4,564,851 | 1/1986 | Nilsson et al. | 347/68 |
| 4,599,628 | 7/1986 | Doring et al. | 347/71 |
| 4,771,295 | 9/1988 | Baker et al. | 347/87 |
| 4,864,325 | 9/1989 | Ohtaka | 347/54 |
| 4,962,391 | 10/1990 | Kitahara et al. | 347/47 |

FOREIGN PATENT DOCUMENTS

| | | | |
|---|---|---|---|
| 57-83459 | 5/1982 | Japan | 347/54 |
| 57-152958 | 9/1982 | Japan | 347/44 |
| 60-19537 | 1/1985 | Japan | 347/54 |
| 1-128839 | 5/1989 | Japan | 347/68 |

*Primary Examiner*—David F. Yockey
*Assistant Examiner*—Judy Nguyen
*Attorney, Agent, or Firm*—Ladas & Parry

[57] ABSTRACT

In a recording apparatus, one marking fluid container is cantilevered from one end at one side of a chamber. The one marking fluid container has an ejection hole and an internal passage from the ejection hole to the chamber for supplying marking fluid from the chamber to the ejection hole, whereby the marking fluid is ejected from the ejection hole by inertia upon release of flexural bending of the one marking fluid container for recording on a recording medium. Another marking fluid container extends in a second direction from one end cantilevered at an opposite side of the chamber. The one marking fluid container has a rectangular cross section transverse to the first direction for accommodating still another marking fluid container in a row. The one and other marking fluid containers cantilevered from the opposite sides of the chamber are parallel and staggered relative to each other.

28 Claims, 8 Drawing Sheets

RECORDING APPARATUS USING MOTIONAL INERTIA OF MARKING FLUID

BACKGROUND OF THE INVENTION

1. Field of the Invention

The present invention relates to a recording apparatus such as a printer or a plotter, wherein marking fluid containers each formed with a ejection port (or ports) are respectively reciprocated back and forth about the ejection port by means of a driving means and intermittently stopped, so that marking fluid can be ejected from each marking fluid container through the ejection port by inertia induced in the marking fluid each time the container is stopped.

2. Description of the Prior Art

A recently spread ink-jet printing method mainly uses the DOD (Drop On Demand) process, and the DOD process has been increasingly and more widely used in the art since ink droplets can be rapidly ejected under atmospheric pressure without being electrically charged nor deflected, whereby the recording operation can be facilitated.

The typical ejection principles are the heating type ejection using resistors and the vibrating type ejection process using piezo-electric transducers.

FIG. 1 illustrates the principal of a heating type ejection process, wherein ink is contained within a chamber a1, each comprising an ejection port a2 opened toward a recording media and a resistor a3 embedded within the bottom wall of the chamber opposite to the ejection port a2 to generate heat for expanding air bubbles within the chamber a1. Therefore, expanded air bubbles will propel ink contained within the chamber a1 through the ejection port and ink droplets will be ejected toward the recording media by the propelling force.

The heating type ejection process includes various disadvantages in that ink undergoes chemical deterioration due to the applied heat and the chemically deteriorated ink deposits on the internal surface of the ink ejection port thereby causing the blocking of the ejection port. Also, the heating resistors have short life spans, and the printed documents cannot be easily recycled since water-soluable inks have to be used.

FIG. 2 illustrates the principal of a vibrating type ejection process, wherein ink is contained within a chamber b1, the chamber comprising an ejection port b2 opened toward a recording media and a piezo-electric transducer b3 embedded within the bottom wall of the chamber opposite to the ejection port b2 to generate vibration. Therefore, as the piezo-electric transducer b3 generates vibration at the bottom wall of the chamber b1, the ink will be propelled through the ejection port b2 and thus will be ejected toward the recording media by the vibration force.

The vibrating type ejection process using vibration generated by the piezo-electric transducers has an advantage that various kinds of inks can be used since it does not use heat. However, the process also entails a disadvantage in that it is difficult to form and install the transducers within the bottom wall of each chamber and thus the productivity thereof is very poor.

FIG. 3 illustrates the principal of a magnetic field applying type ejection process, wherein ink is contained within a pipe c1, magnets c2 and c3 are disposed at the upper and lower sides of the pipe c1, respectively, and an ejection port c4 is formed at one end of the pipe, and wherein electric current is applied to the ink between the magnets c2 and c3. The ink contained within the pipe is electrically charged and thus will be ejected by magnetic force generated between the magnets c2 and c3 through the ejection port c4 and toward a recording media, when electric current is applied to the ink.

The magnetic field applying type ejection process has disadvantages in that ejection ports are easily blocked by the corrosion of electrodes, power consumption is very high, and it is difficult to select magnetic materials.

The conventional printing methods as explained in the above have additional disadvantages as follows:

Printers using the above mentioned ejection processes have a resolution of about 600 DPI (dots per inch) and it is not easy to enhance the DPI more densely. Since, as can be seen from FIG. 4, the diameter d1 of chambers for supplying ink is two or more times greater than the diameter d2 of ejection ports and, particularly in the case of the heating type ejection process, heat generated from a resistor within a chamber can affect the adjacent chambers and cause malfunction, it is impossible to reduce the distances d3 between two adjacent chambers.

Furthermore, the thickness of plates d4 forming ejection ports d5 is relatively thick in printers adopting any of the. above ejection processes in order for ink droplets to arrive at. exact target points on a recording media without diffusion or deviation. However, since lengths of the ejection ports are too long, foreign matter such as cured ink and dusts easily deposits on the internal surfaces of the ejection ports and block the ejection ports after long periods of use. This problem cannot be solved by merely modifying the ingredients of the ink itself.

SUMMARY OF THE INVENTION

Accordingly, the present invention is conceived to solve the problems as explained above. The main purposes of the present invention is to provide a recording apparatus adopting a novel process of ejecting marking fluid, in particular to achieve the maximum possible resolution (DPI) by minimizing the distances between the adjacent marking fluid ejection ports as compared with the diameters thereof on one hand, and to prevent the blocking of ejection ports from being blocked by reducing the lengths of the ejection ports as much as possible on the other hand. It is also a purpose of the present invention to provide more reliable printing apparatus to enhance commodity value.

The features of the present invention for achieving the above purposes comprises:

- marking fluid containers each formed with a port for ejecting marking fluid toward a recording media to be printed;
- ejection section rows each composed of a series of the marking fluid ejecting ports repeatedly and parallelly arranged;
- one or more fluid chamber, to each side of which chamber one ejection section row is connected; and
- driving means for reciprocating the marking fluid containers relative to the recording media, whereby a marking fluid droplet is ejected by inertia induced in the marking fluid each time a container is stopped.

Especially, electrostatic or magnetic force can be used as the driving means.

BRIEF DESCRIPTION OF THE DRAWINGS

FIGS. 9A to 9C show driving states of driving means of the present invention in cross-section view, wherein FIG. 9A shows the state that a marking fluid container is moved back and potential energy is preserved in this marking fluid, FIG. 9B shows the state that the advancing movement of the marking fluid container is completed and the marking fluid is being ejected by inertia induced in the marking fluid, and FIG. 9C shows the state that the marking fluid container is moved back again and elastic energy is preserved in the marking fluid container.

DESCRIPTION OF THE PREFERRED EMBODIMENTS

According to the present invention, marking fluid container, having marking fluid ejection ports are reciprocated and the marking fluid within a marking fluid ejection port is ejected by inertia induced in the fluid the moment the marking fluid container with the ejection port is stopped.

Figure 1:
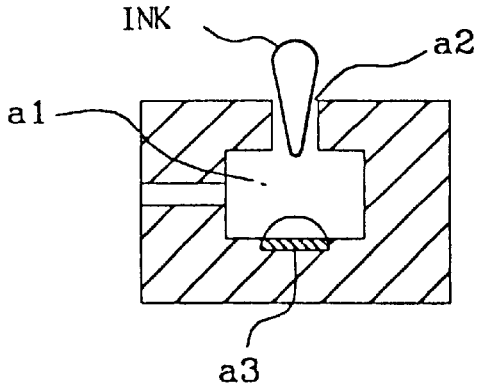
FIG. 1 PRIOR ART
FIG. 1 illustrates a heating type ejection process of the prior art.
Figure 2:
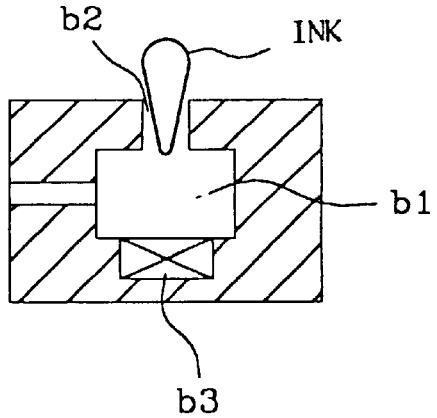
FIG. 2 PRIOR ART
FIG. 2 illustrates a vibrating type ejection process of the prior art.
Figure 3:
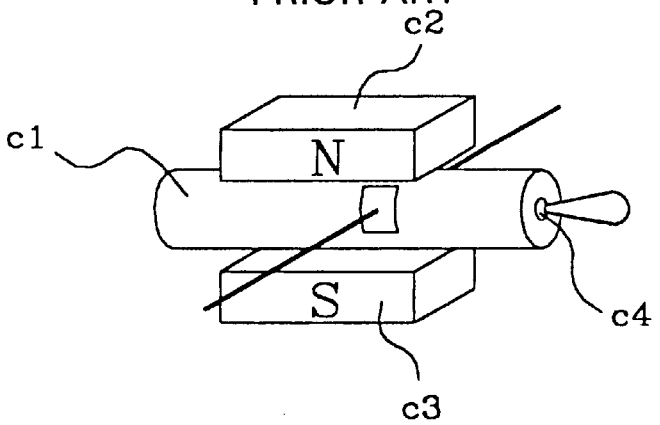
FIG. 3 PRIOR ART
FIG. 3 illustrates a magnetic field applying type ejection process of the prior art.
Figure 4:
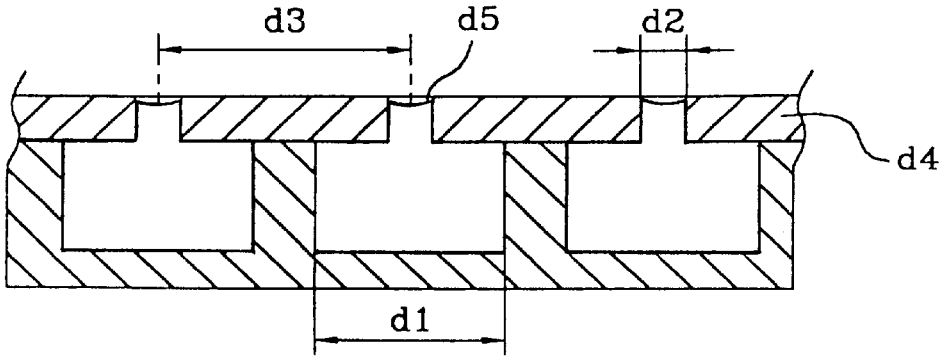
FIG. 4 PRIOR ART
FIG. 4 is a cross section view illustrating problems of the prior art.
Figure 5:
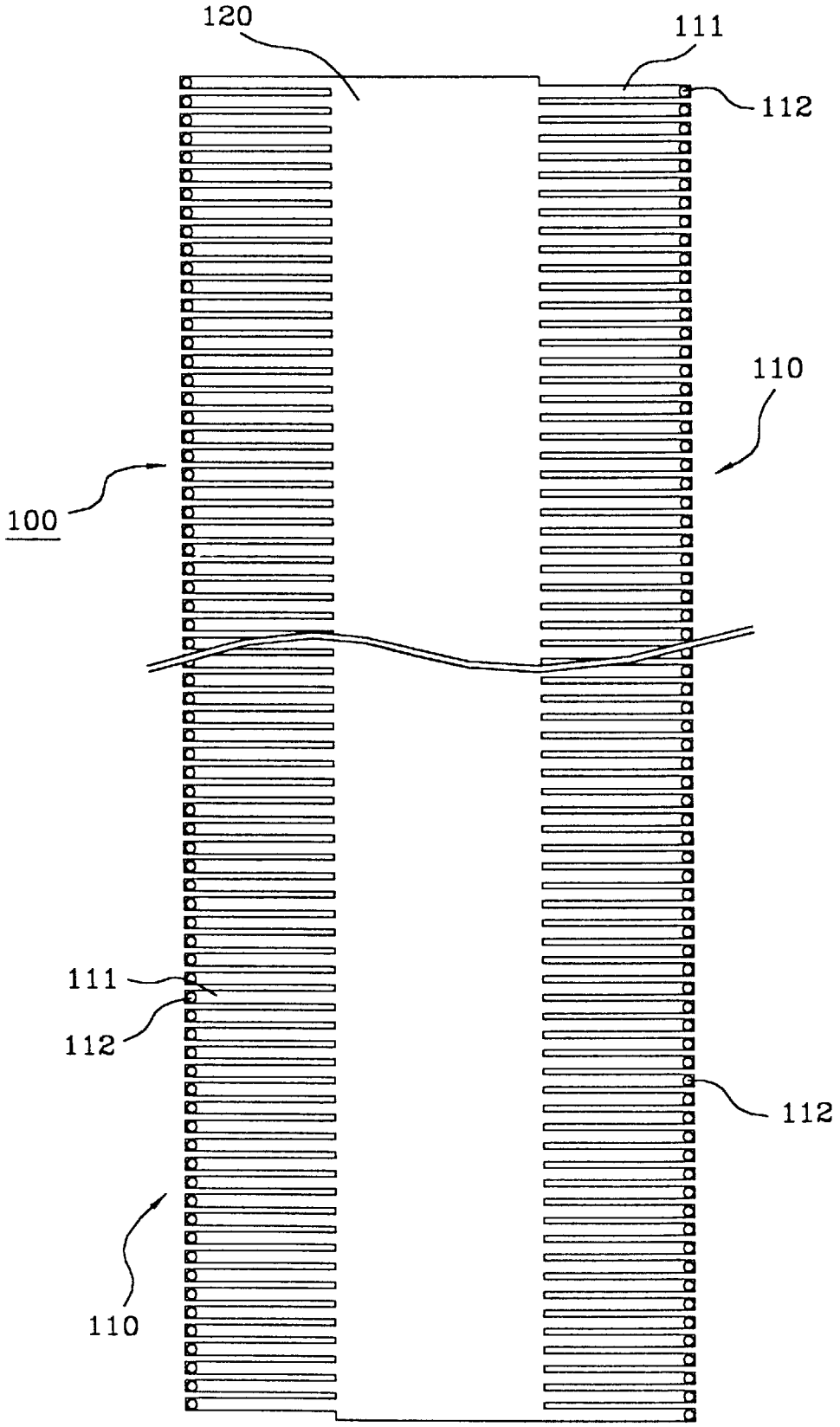
FIG. 5 illustrates the construction of a printing head in accordance with the present invention.
Figure 6:
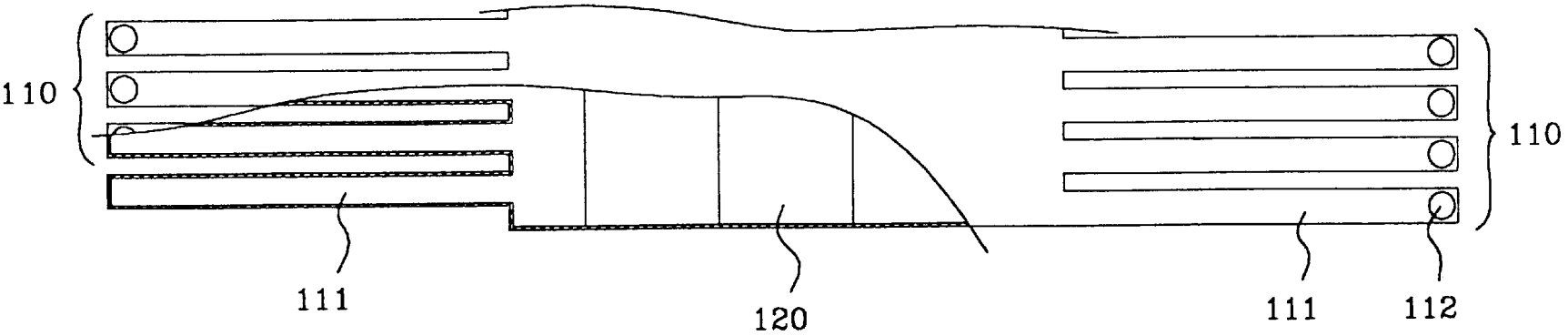
FIG. 6 is a partial plan view of the printing head of FIG. 5 shown in enlarged scale and in partial section.
Figure 7:
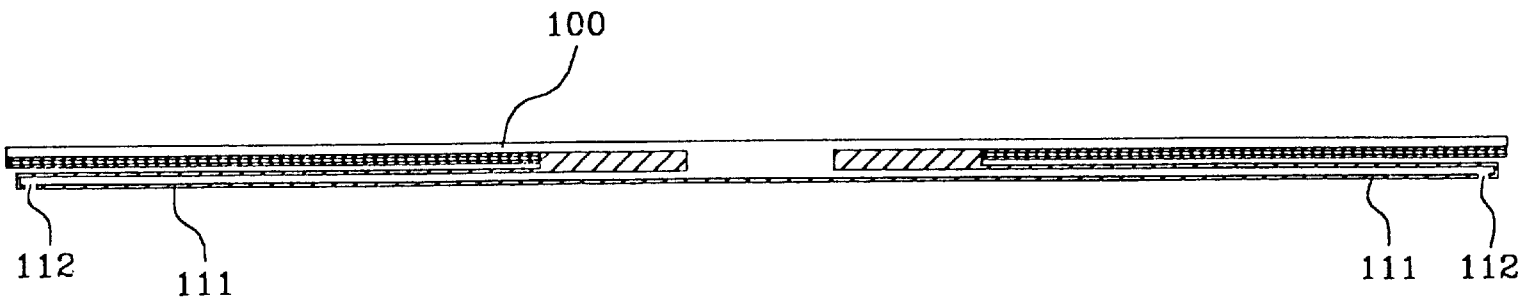
FIG. 7 is a cross-section view of the printing head of FIG. 5.

FIG. 5 is an illustration showing the construction of a printing head 100 in accordance with the present invention, FIG. 6 is a partial section view of the printing head shown in enlarged scale, and FIG. 7 is a cross-section view of the printing head of FIG. 5.

First, marking fluid containers of the present invention will be explained.

In reciprocating marking fluid containers, a preferred embodiment of the present invention adopts swivel reciprocating movements of the marking fluid containers rather than rectilinear reciprocating movements, since it is more easy to achieve the former by forming the marking fluid containers in a rod shape so that they can conduct swivel movements by elastic deformation thereof.

However, if exact reciprocating movements of the marking fluid container relative to the recording media are ensured, marking fluid containers can be formed in a spherical or regular-hexahedron shape rather than a rod shape.

The head 100 comprises a centrally located marking fluid chamber(s) 120, and two rows of marking fluid sections 110 each row arranged on right and left sides of the marking fluid chamber, respectively, as shown in FIG. 5.

Each row of the marking fluid sections 110 is composed of a plurality of marking fluid containers 111, each having an elongated rod shape and provided with a marking fluid ejection port.

The marking fluid FIG. 5 illustrates a marking fluid container 111 of the present invention which is a hollow tubular body formed in a rod shape and provided with an ejection port 112 at one end thereof.

Furthermore, marking fluid containers 111 of the left ejection section row 110 are arranged in an alternating zig-zag pattern with regard to marking fluid containers of the right ejection section row 110 disposed in the right side of the fluid chamber 120, so that the marking fluid ejected from ejection ports 112 of one marking fluid ejection section row does not overlap the marking fluid ejected from ejection ports of the other ejection section row, thereby increasing the dot density, i.e., the DPI.

It is preferred to form the marking fluid containers from a hollow tubular body pipe with a rectangular cross-section having a width longer than a height, so that the internal ends thereof are integratedly connected with the marking chamber fluid chamber 120 and the external ends provided with ejection ports 112 conduct flexural swivel movements. However, a tubular body with a circular cross-section, or a oval or polygonal cross-section having a width longer than a height may be used to form the containers.

Figure 14:
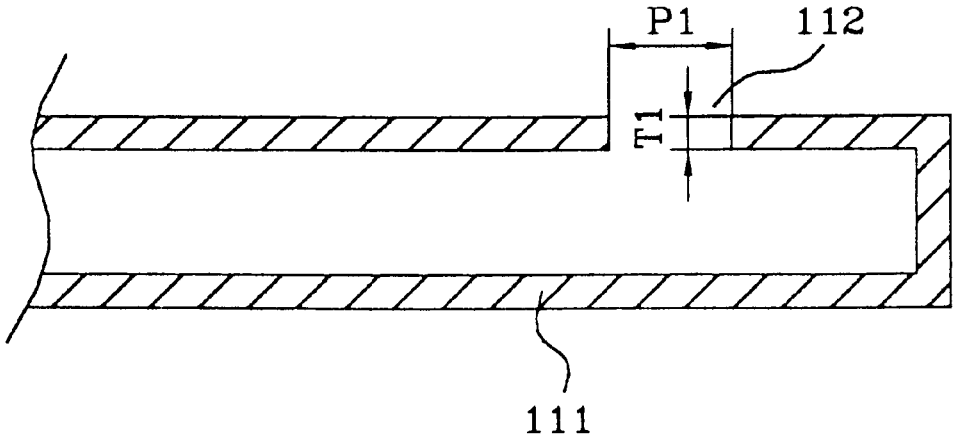
FIG. 14 is a partial cross-section view showing an ejection port in accordance with the present invention.

In order to more effectively prepare the marking fluid container 111 exemplified in the present invention, it is necessary to extremely cleanly process the internal surface of the tubular body. Therefore, it is desirable to inject etching liquid into the tubular body to remove any remaining matter deposited within the tubular body. In this connection, one or more etching liquid injection holes 112 may be formed in a side of the marking fluid container 111 to be longitudinally arranged (see FIG. 14). The dimension of the hole(s) is determined to be so small that the holes cannot affect the ink ejection.

Next, several driving means for reciprocating the marking fluid containers 111 will be explained by example.

Figure 8:
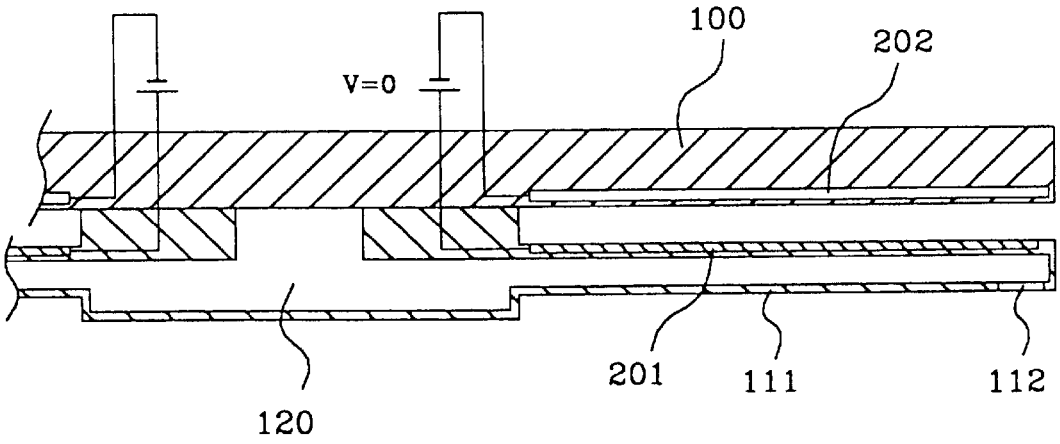
FIG. 8 is a partial enlarged cross-section view.

It is most desirable to use electrostatic force as the driving means as shown in FIG. 8. In this embodiment, one electrode plate 201 is embedded within each rod shaped marking fluid container 111 and other electrode plates 202 are embedded within the printing head each to be opposite and spaced at a distance from the one electrode plate 201, whereby the rod shaped container 111 can be elastically shaken by electrostatic force generated between the two opposite electrode plates related to the rod shaped container 111.

In order to effectively control the electrostatic force, it is possible to supply electric current one of the electrode plates 201 and 202.

It is also possible to omit one of the electrode plates from the marking fluid containers or the printing head and, in such a case, it is desirable to form the side, from which the electrode is omitted, using a material sensitive to electrostatic force. For example, if tungsten (W) electrode plates 202 exerting electrostatic force when electric current is supplied are embedded within the printing head 100, it is possible to form the marking fluid containers 111 using a metal such as nickel (Ni) without embedding an electrode plate.

Figure 10:
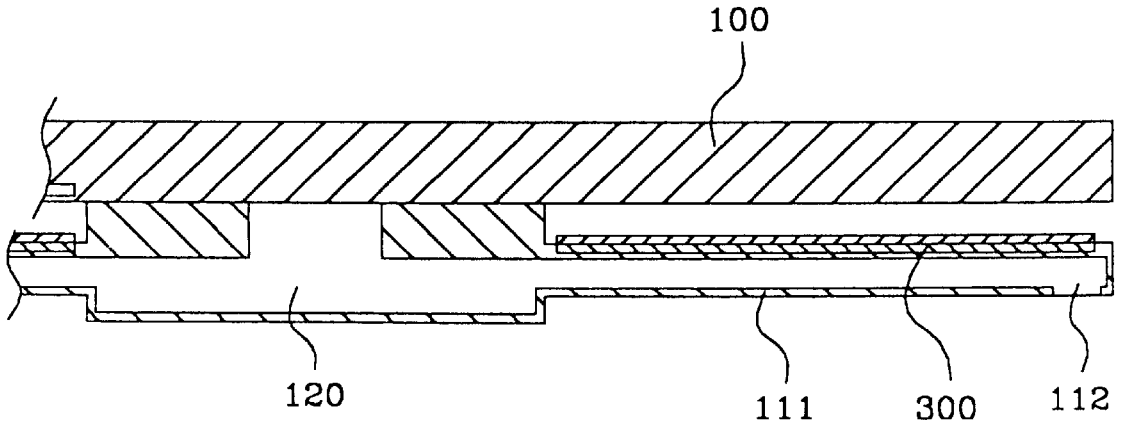
FIG. 10 is a partial cross-section view showing another embodiment using bi-metals as driving means.

According to another embodiment of the invention, as shown in FIG. 10, it is possible to attach a double layered device such as a bi-metal device composed of two components having different thermal expansion coefficients on respective rod shaped marking fluid container, whereby the marking fluid container 111 can be shaken by the bi-metal device every moment heat or current is supplied to the bi-metal device.

When the bi-metal device 300 is heated, it will be bent from one side with a larger thermal expansion coefficient toward the other side with a smaller thermal expansion coefficient, whereby the bending force will be applied to the marking fluid container 111 to which the bi-metal device is attached.

Figure 11:
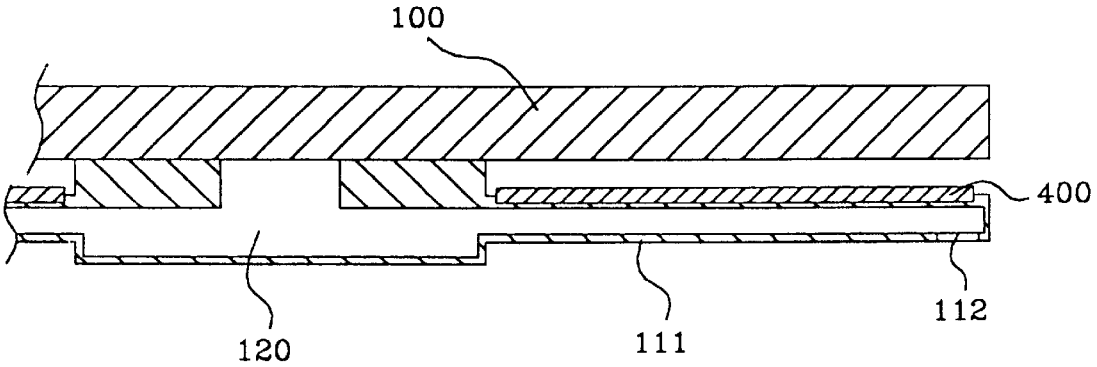
FIG. 11 is a partial cross-section view showing another embodiment using piezo-electric devices as driving means.

With reference to FIG. 11 showing another embodiment of driving means of the present invention, a Bimorph type piezo-electric device used as the driving means is attached to each marking fluid container, whereby one ends of the selected marking fluid containers can be shaken when an electric current source is connected to the piezo-electric devices attached to the fluid containers.

The piezo-electric device 400 has a nature that its volume is expanded when the electric current source is connected to the, device. Therefore, one end of the respective marking fluid. container 111 can be pulled or pushed and thus the marking fluid container can be shaken by the piezo-electric device 400 attached on a side surface of each marking fluid container 111 or inserted between the marking fluid container 111 and the printing head 100 to be extended in vertical direction thereto.

Figure 12:
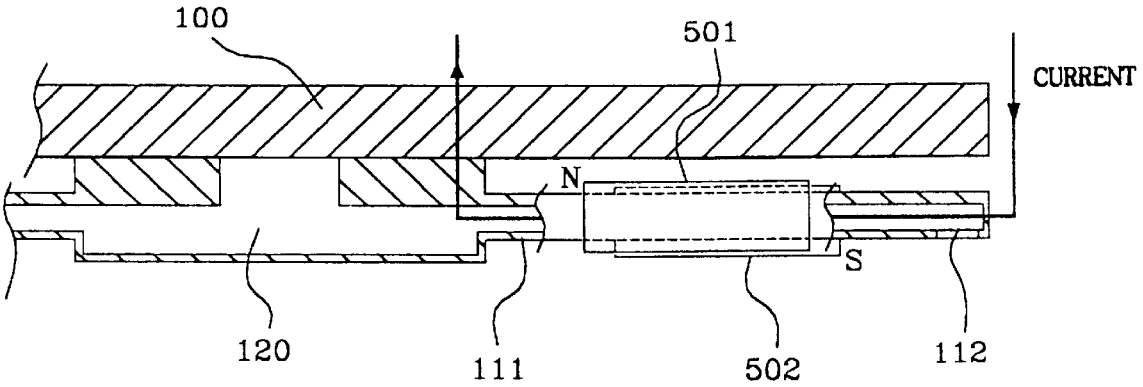
FIG. 12 is a partial cross-section view showing another embodiment using electromagnets as driving means.

Another embodiment shown in FIG. 12 uses magnetic force as driving means. This embodiment is similar to the embodiment using electrostatic force but uses magnets 501 and 502 disposed around each marking fluid container in place of electrode plates to generate magnetic field when electric current is applied to the marking fluid container 111, whereby magnetic force acting in a predetermined direction can shake the marking fluid container 111. The magnetic force can be controlled by electric current, whereby ejection force of marking can be adjusted.

The recording apparatus of the present invention constructed as explained in the above operates in the following manner.

Figure 9A:
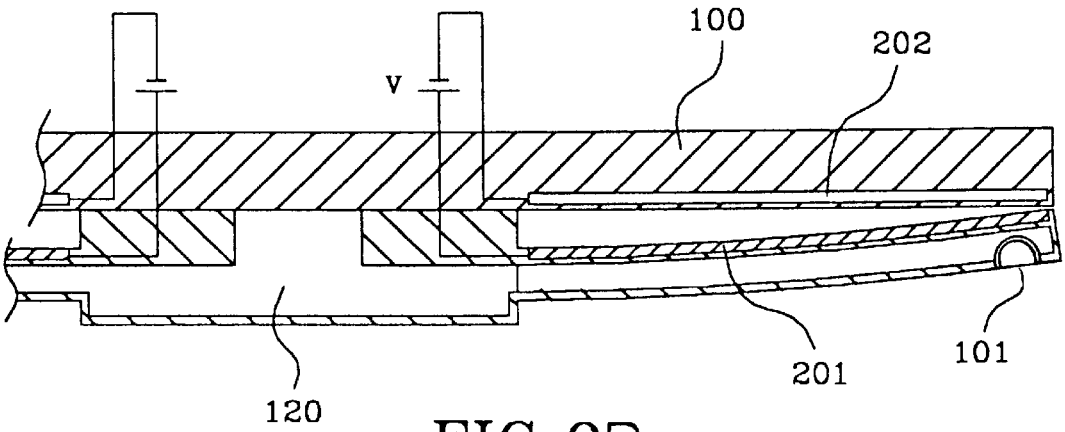

As can be seen from FIG. 8, each of the marking fluid containers 111 receives marking fluid 101 from the fluid chamber 120 connected to the printing head 100, that flows into an ejection port 112 formed on one end of each marking fluid container by capillary suction action. In this state, if an electric source is connected to an electrode plate 201, the electric plate 202 will generate electrostatic force and the one end of marking fluid container 111 will make a backward movement, as shown in FIG. 9A. Therefore, the marking fluid container 111 will preserve elastic energy and the marking fluid contained within the marking fluid container will preserve. potentional energy.

Figure 9B:
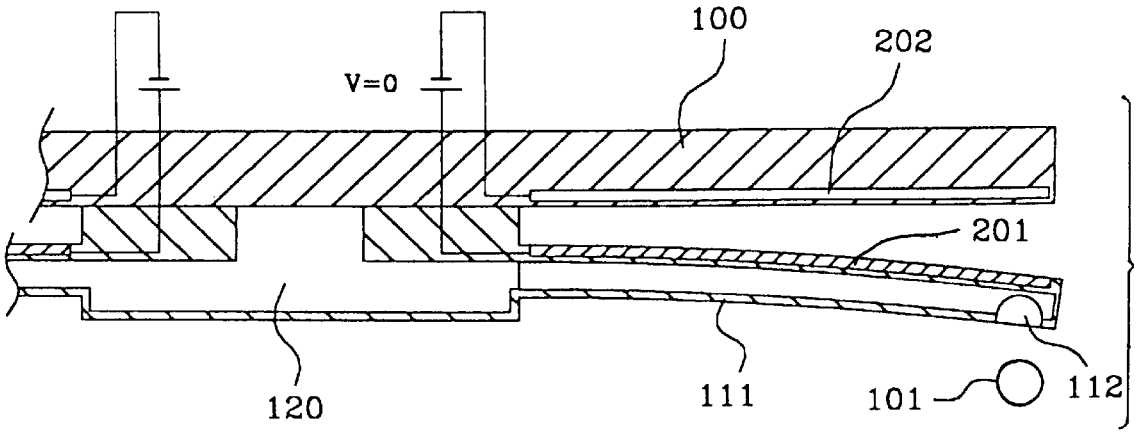

Thereafter, if the electric source is cut off and thus. electrostatic force disappears from the electrode plate 201, the one end of the marking fluid container will conduct a forward swivel movement as shown in FIG. 9B and, when the one end of the marking fluid container arrives at the peak point, the marking fluid will be ejected toward the recording media through the ejection port 112 in a droplet form since the marking fluid preserves inertia inertia.

Figure 9C:
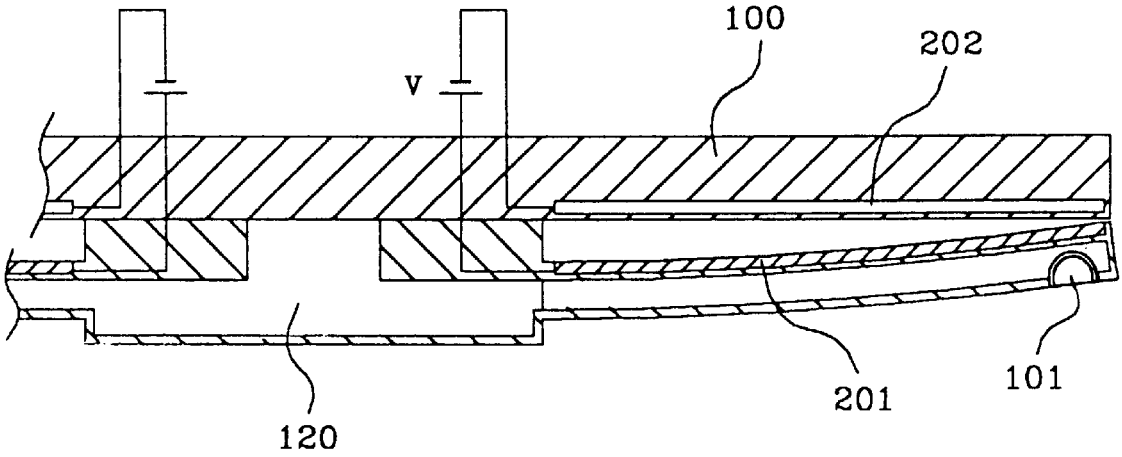

Thereafter, if the electric source is connected again, electrostatic force will be generated again and the marking fluid container 111 will make another backward movement as shown in FIG. 9C. During this process, the marking fluid container 111 will be continuously refilled with marking fluid 101 and prepare the next ejection.

Figure 15:
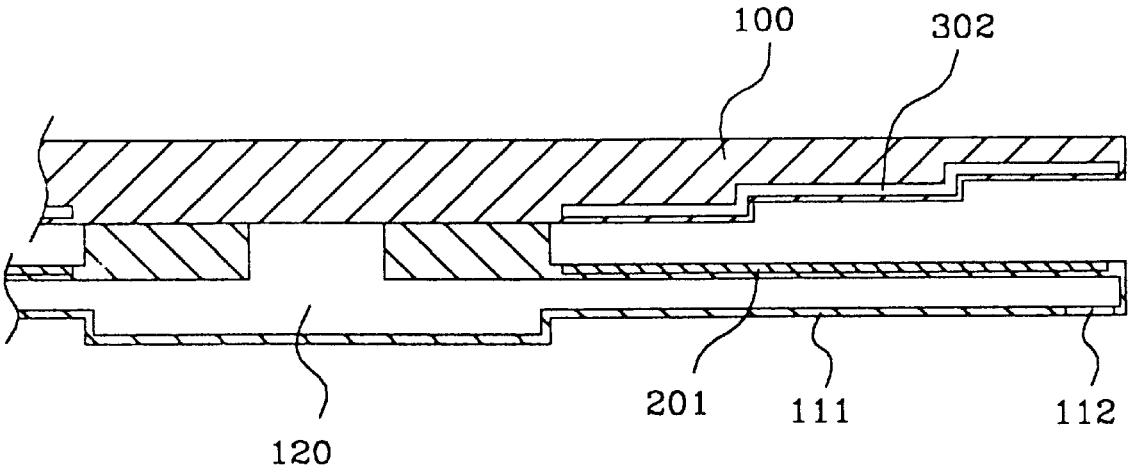
FIG. 15 is a cross-section view showing another embodiment of the electrode plate of the present invention.
Figure 16:
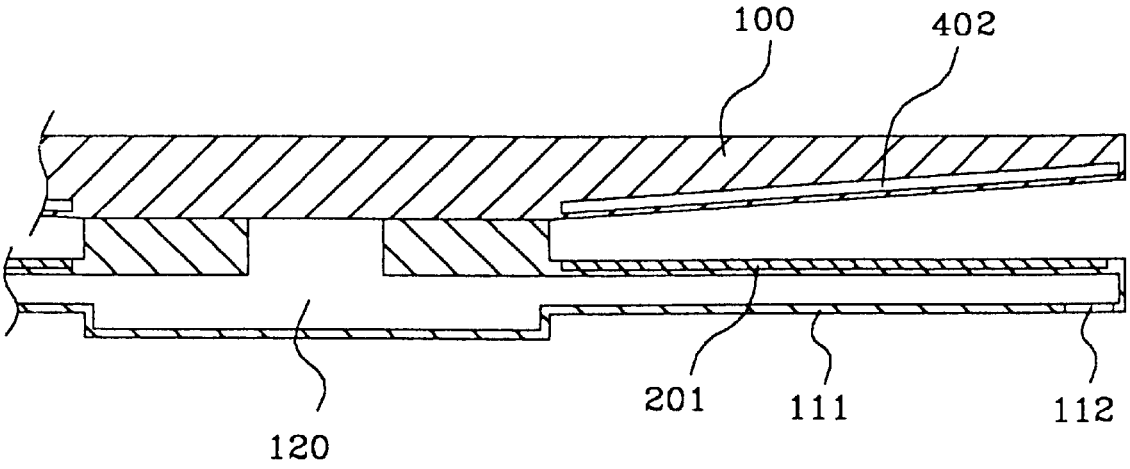
FIG. 16 is cross-section view showing further embodiment of the electrode plate of the present invention.

As shown in FIGS. 15 and 16, the electrode plates 202 may have a stepped shape 302 or an oblique shape 402.

In ejecting the marking fluid 101, the ejecting force of marking fluid can be adjusted by i) previously adjusting the length of the marking fluid containers, ii) increasing or reducing the distance between the electrode plates 201 and 202 to adjust the flexual distance and hence the elastic force of the marking fluid containers, and/or iii) transforming electric voltage supplied to the electrode(s) to adjust magnetic force.

By repeating the steps shown in FIGS. 9A to 9C, the marking fluid 101 can be continuously ejected and the marking fluid containers 111 of each ejection section 110 can be independently operated. Therefore, desired recording contents can be printed if the centrally disposed fluid chamber(s) 120 and fluid ejection sections 110 each connected right and left sides of the fluid chamber are operated in combination in response to on/off operations of electric source commanded by predetermined separate signals.

Figure 13:
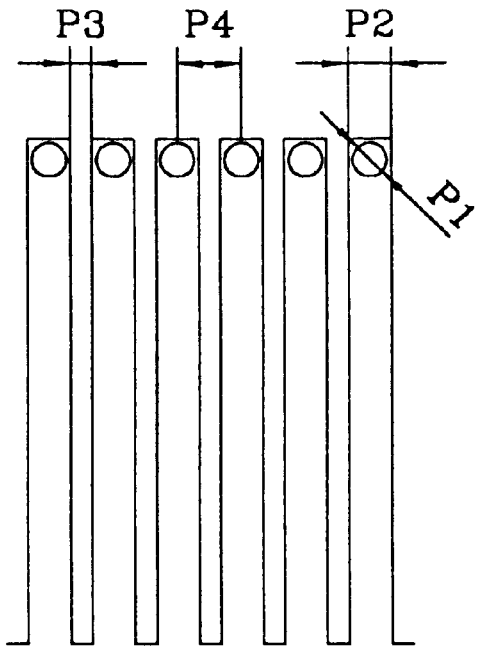
FIG. 13 is a partial view for illustrating functional effects of the present invention.

In accordance with the present invention, since kinetic energy is induced in marking fluid during the repeated reciprocating movements of marking fluid containers, and a droplet of marking fluid is ejected from an ejection port 112 on each marking fluid container toward a recording media when the container is stopped as explained in detail in the above, each of the ejection ports can be formed to occupy most of the area of each marking fluid container. Therefore, if the ejection port 112 is formed to have a diameter same with that of conventional one, the marking fluid container 111 can be formed to have a narrower area P2 approximately same with that of the ejection port 112, as shown in FIG. 13. Furthermore, since it is sufficient if a marking fluid container 111 does not interfere with an adjacent marking fluid, the gaps P3 can be minimized and thus the distances P4 between the ejection ports can also be minimized, whereby the DPI can be extremely increased.

In accordance with the present invention, since marking fluid is spontaneously ejected from the ejection port by inertia induced in the marking fluid in response to kinetic energy of the marking fluid container itself without any external propelling force used in the prior art, the ejected marking fluid forms a complete droplet without being widely spreaded and can exactly arrive at a target point on the recording media in spite of the fact that the ejection port has a very short thickness T1. Therefore, the ejection port is not blocked nor narrowed by dust and/or cured marking fluid and thus recorded conditions can be satisfactorily maintained.

What is claimed is:

1. A recording apparatus comprising:

a head having a first surface;

a chamber on the first surface and having one side projecting from the first surface, the chamber being for containing a marking fluid;

one marking fluid container having one end, an opposite end, a second surface facing the first surface, a third surface, a fourth surface and a fifth surface, the second, third, fourth and fifth surfaces extending in a first direction from the one end to the opposite end, the second and third surfaces being opposite each other and the fourth and fifth surfaces being opposite each other, the one marking fluid container being cantilevered from the one end at the one side of the chamber such that the first and second surfaces are spaced apart, the one marking fluid container further having an ejection hole in the third surface spaced from the one end, and an internal passage from the ejection hole to the one end for supplying the marking fluid from the chamber to the ejection hole;

means at least at one of the first and second surfaces for flexurally bending the one marking fluid container toward the first surface and releasing the one marking fluid container, whereby the marking fluid is ejected from the ejection hole upon the release by inertia for recording an a recording medium; and another marking fluid container extending in a second direction from one end cantilevered at an opposite side of the chamber that also projects from the first surface;

wherein the second, third, fourth and fifth surfaces give the one marking fluid container a rectangular cross section transverse to the first direction;

wherein the one and other marking fluid containers are cantilevered at the one and opposite sides of the chamber staggered relative to each other; and wherein the first direction of the one marking fluid container and the second direction of the other marking fluid container are parallel.

2. The recording apparatus according to claim 1, and further comprising a still other marking fluid container in a row adjacent to the fourth or fifth surface with a gap between the one marking fluid container and the still other marking fluid container for the bending to be independent of the still other marking fluid container.

3. The recording apparatus according to claim 1, wherein the means comprises an electrode.

4. The recording apparatus according to claim 1, wherein the means comprises a piezoelectric device.

5. The recording apparatus according to claim 1, wherein the means comprises an electromagnet.

6. The recording apparatus according to claim 1, wherein the one and other marking fluid containers are at least similar.

7. The recording apparatus according to claim 2, wherein the means comprises an electrode.

8. The recording apparatus according to claim 2, wherein the means comprises a piezoelectric device.

9. The recording apparatus according to claim 2, wherein the means comprises an electromagnet.

10. The recording apparatus according to claim 2, wherein the one and still other marking fluid containers are at least similar.

11. The recording apparatus according to claim 2, wherein the one and other marking fluid containers are identical.

12. The recording apparatus according to claim 7, wherein the one and other marking fluid containers are identical.

13. The recording apparatus according to claim 7, wherein the electrode has a stepped shape.

14. The recording apparatus according to claim 7, wherein the electrode has an oblique shape.

15. The recording apparatus according to claim 12, wherein the electrode has a stepped shape.

16. The recording apparatus according to claim 12, wherein the electrode has an oblique shape.

17. The recording apparatus according to claim 8, wherein the one and other marking fluid containers are identical.

18. The recording apparatus according to claim 9, wherein the one and other marking fluid containers are identical.

19. The recording apparatus according to claim 10, wherein the one and still other marking fluid containers are identical.

20. The recording apparatus according to claim 19, wherein the one and other marking fluid containers are identical.

21. The recording apparatus according to claim 3, wherein the one and other marking fluid containers are identical.

22. The recording apparatus according to claim 3, wherein the electrode has a stepped shape.

23. The recording apparatus according to claim 3, wherein the electrode has an oblique shape.

24. The recording apparatus according to claim 21, wherein the electrode has a stepped shape.

25. The recording apparatus according to claim 21, wherein the electrode has an oblique shape.

26. The recording apparatus according to claim 4, wherein the one and other marking fluid containers are identical.

27. The recording apparatus according to claim 9, wherein the one and other marking fluid containers are identical.

28. The recording apparatus according to claim 19, wherein the one and other marking fluid containers are identical.

* * * * *